US012540532B2

(12) United States Patent
Hoelscher

(10) Patent No.: US 12,540,532 B2
(45) Date of Patent: Feb. 3, 2026

(54) HOOP STRESS REDUCER IN PERFORATING GUNS

(71) Applicant: Halliburton Energy Services, Inc., Houston, TX (US)

(72) Inventor: Christopher C. Hoelscher, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/371,285

(22) Filed: Sep. 21, 2023

(65) Prior Publication Data

US 2025/0101839 A1 Mar. 27, 2025

(51) Int. Cl.
*E21B 43/119* (2006.01)
*E21B 43/116* (2006.01)

(52) U.S. Cl.
CPC ..... *E21B 43/1195* (2013.01); *E21B 43/116* (2013.01)

(58) Field of Classification Search
CPC ... E21B 43/117; E21B 43/116; E21B 43/1195
See application file for complete search history.

(56) References Cited

U.S. PATENT DOCUMENTS 4,539,909 A 9/1985 Day et al.
4,703,986 A 11/1987 McCormick
4,718,345 A 1/1988 Yunan
4,778,404 A 10/1988 Pass
5,201,598 A 4/1993 Tehan
5,366,013 A * 11/1994 Edwards ..... E21B 17/07 166/55.1
5,775,419 A * 7/1998 Gramlich ..... E21B 33/08 166/84.1
6,059,595 A 5/2000 Lacrouts-Cazenave
6,112,813 A * 9/2000 Head ..... E21B 17/206 166/57
6,783,405 B1 8/2004 Yen
7,121,340 B2 10/2006 Grove et al.
7,197,985 B2 4/2007 Markel et al.
8,286,697 B2 10/2012 Evans et al.
(Continued)

FOREIGN PATENT DOCUMENTS

DE 102021108869 A1 11/2021
WO 2016118179 7/2016
(Continued)

OTHER PUBLICATIONS

International Search Report and Written Opinion for International Patent Application No. PCT/US2023/083902 dated Apr. 18, 2024. PDF file. 10 pages.
(Continued)

*Primary Examiner* — D. Andrews
(74) *Attorney, Agent, or Firm* — John Wustenberg; C. Tumey Law Group PLLC

(57) ABSTRACT

In general, in one aspect, embodiments relate to a perforating gun that includes a gun body, a charge tube disposed within the gun body, a plurality of charge cases disposed within the charge tube, and a sacrificial fill material disposed within at least a substantial portion of an inner cavity of the charge tube.

15 Claims, 10 Drawing Sheets

(56) References Cited

U.S. PATENT DOCUMENTS

| | | | | |
|---|---|---|---|---|
| 8,347,963 | B2 * | 1/2013 | Johnson | E21B 49/08 175/4.54 |
| 8,555,764 | B2 | 10/2013 | Le et al. | |
| 8,939,802 | B2 | 1/2015 | Hara et al. | |
| 8,978,749 | B2 | 3/2015 | Rodgers et al. | |
| 9,523,265 | B2 | 12/2016 | Upchurch et al. | |
| 9,605,937 | B2 | 3/2017 | Eitschberger et al. | |
| 10,365,078 | B2 | 7/2019 | Eitschberger | |
| 10,415,353 | B2 | 9/2019 | Robey et al. | |
| 10,669,821 | B2 | 6/2020 | Knight et al. | |
| 11,078,761 | B2 | 8/2021 | Grove et al. | |
| 11,098,563 | B1 | 8/2021 | Ludwig | |
| 11,299,967 | B2 | 4/2022 | Bradley et al. | |
| 11,313,208 | B2 | 4/2022 | Hoelscher et al. | |
| 11,359,468 | B2 | 6/2022 | Roberts et al. | |
| 11,547,976 | B2 | 1/2023 | Ledwon et al. | |
| 11,560,778 | B2 | 1/2023 | Grove et al. | |
| 11,608,720 | B2 | 3/2023 | Preiss et al. | |
| 11,674,370 | B2 | 6/2023 | Shelton et al. | |
| 11,906,279 | B2 | 2/2024 | Eitschberger | |
| 12,264,561 | B2 | 4/2025 | Roberts et al. | |
| 12,312,923 | B2 | 5/2025 | Cook et al. | |
| 12,320,203 | B2 | 6/2025 | Roberts et al. | |
| 12,352,551 | B2 | 7/2025 | Roberts et al. | |
| 2003/0047313 | A1 | 3/2003 | Wehunt, Jr. | |
| 2004/0216633 | A1 | 11/2004 | Kash | |
| 2004/0216866 | A1 | 11/2004 | Barlow et al. | |
| 2005/0236183 | A1 | 10/2005 | Grove et al. | |
| 2007/0084336 | A1 | 4/2007 | Neves | |
| 2007/0107589 | A1 | 5/2007 | Rospek et al. | |
| 2007/0119327 | A1 | 5/2007 | Myers, Jr. et al. | |
| 2009/0151589 | A1 * | 6/2009 | Henderson | F42D 3/04 102/333 |
| 2010/0227514 | A1 | 9/2010 | Rikimaru et al. | |
| 2010/0276136 | A1 * | 11/2010 | Evans | E21B 43/117 166/55.2 |
| 2011/0042089 | A1 | 2/2011 | Chang et al. | |
| 2011/0127045 | A1 * | 6/2011 | Spence | E21B 33/02 277/314 |
| 2012/0181026 | A1 * | 7/2012 | Le | E21B 43/1195 166/55 |
| 2014/0065351 | A1 * | 3/2014 | Cordner | B29C 55/005 428/116 |
| 2014/0260591 | A1 * | 9/2014 | Rodgers | E21B 43/1195 73/152.58 |
| 2016/0356132 | A1 | 12/2016 | Burmeister et al. | |
| 2016/0376879 | A1 | 12/2016 | Goodman et al. | |
| 2017/0145798 | A1 * | 5/2017 | Robey | E21B 43/117 |
| 2017/0275974 | A1 | 9/2017 | Von Kaenel et al. | |
| 2018/0112500 | A1 | 4/2018 | Collins et al. | |
| 2020/0024935 | A1 | 1/2020 | Eitschberger et al. | |
| 2020/0048996 | A1 | 2/2020 | Anthony et al. | |
| 2020/0200516 | A1 | 6/2020 | Zemla et al. | |
| 2020/0248535 | A1 | 8/2020 | Goyeneche | |
| 2020/0256166 | A1 | 8/2020 | Knight et al. | |
| 2020/0392819 | A1 | 12/2020 | Robey et al. | |
| 2021/0172298 | A1 | 6/2021 | Knight et al. | |
| 2021/0222525 | A1 | 7/2021 | Dyess et al. | |
| 2021/0277752 | A1 | 9/2021 | Eitschberger | |
| 2021/0332678 | A1 | 10/2021 | Anthony et al. | |
| 2021/0396103 | A1 | 12/2021 | MacGillivray et al. | |
| 2022/0010660 | A1 | 1/2022 | Dyess et al. | |
| 2022/0018226 | A1 | 1/2022 | Wells et al. | |
| 2022/0018227 | A1 | 1/2022 | Kash et al. | |
| 2022/0099423 | A1 | 3/2022 | Sullivan et al. | |
| 2022/0127935 | A1 | 4/2022 | Grove et al. | |
| 2022/0145732 | A1 | 5/2022 | Anthony et al. | |
| 2022/0282600 | A1 | 9/2022 | Dyess et al. | |
| 2023/0069950 | A1 | 3/2023 | Badii et al. | |
| 2023/0184066 | A1 | 6/2023 | Hoelscher et al. | |
| 2024/0210151 | A1 | 6/2024 | Roberts et al. | |

FOREIGN PATENT DOCUMENTS

| | | | |
|---|---|---|---|
| WO | 2021198145 | A1 | 10/2021 |
| WO | 2022184731 | A1 | 9/2022 |

OTHER PUBLICATIONS

International Search Report and Written Opinion for International Patent Application No. PCT/US2023/080589 dated Mar. 19, 2024. PDF file. 10 pages.

International Search Report and Written Opinion for International Patent Application No. PCT/US2023/080587 dated Mar. 19, 2024. PDF file. 8 pages.

International Search Report and Written Opinion for International Patent Application No. PCT/US2023/076255 dated Jun. 14, 2024. PDF file. 12 pages.

Halliburton. Velocity™ Perforating System Improved Surface Efficiency and Downhole Reliability. Halliburton, 2017. H012737 Dec. 2017. PDF file. 1 page.

Halliburton. Velocity™ Aligned Gun System. Halliburton, 2023. H014094 Feb. 2023. PDF file. 2 pages.

Halliburton. Velocity™ Revolve Gun System. Halliburton, 2023. H014095 Feb. 2023. PDF file. 2 pages.

Halliburton, Velocity Perforating System Plug and Play Guns For Pumpdown Operations, Halliburton, 2021. H012844WP Mar. 2021. PDF file. 8 pages.

* cited by examiner

HOOP STRESS REDUCER IN PERFORATING GUNS

BACKGROUND

Wells are often drilled to extract hydrocarbons, such as oil and gas. After drilling a wellbore that traverses a hydrocarbon-bearing formation, a casing string is installed to reinforce portions of the wellbore. A casing string comprises various diameter metal tubulars that are connected end to end, lowered into the wellbore, and cemented in place. The casing string increases the integrity of the wellbore and provides a structure for supporting other wellbore equipment such as production tubing used for producing fluids from one or production zones of the formation to surface. When a production zone is lined with casing, the casing must be perforated in order for formation fluids to enter the wellbore. These perforations are hydraulic openings that extend through the casing and into the surrounding formation.

Typically, perforations are created by lowering a perforating gun string downhole and detonating a series of explosive shaped charges adjacent to the production zone. An explosive train is initiated to detonate the shaped charges in a predetermined, serial fashion. The perforating gun string may then be retrieved to the surface.

One common problem is that due to the tremendous amount of pressure associated with the detonation, the yield strength of the tubular bodies of the perforating gun may be overcome which can lead to gun failure. This may create problems when retrieving the guns, which may be deformed and need to be "fished out," e.g., using fishing tools. In worst case scenarios, the failed perforating gun may be so deformed that retrieval is impossible sometimes resulting in well abandonment. Across the board, failed perforating guns represent a major concern of the oil and gas industry, causing high amounts of nonproductive time at well sites, higher costs of operations, and in some cases, decreased productivity of the well or even well abandonment, as mentioned.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
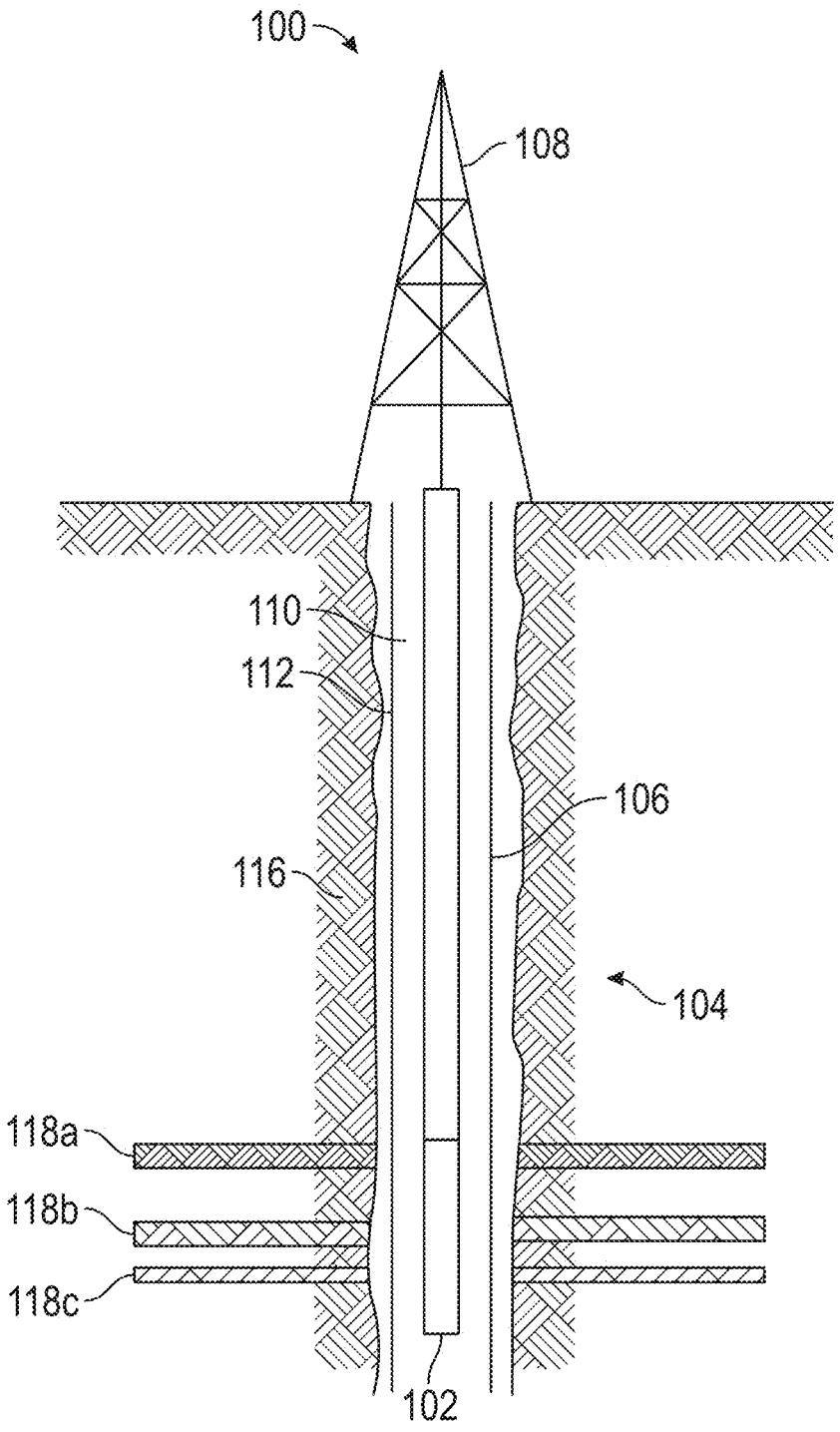
FIG. 1 is a system showing a perforating gun in a wellbore during a land-based operation, in accordance with some embodiments of the present disclosure.

Disclosed herein are perforating gun strings and methods of use thereof in wellbores and, more particularly, disclosed is a perforating gun having one or more internal cavities filled with a sacrificial fill material. Also disclosed are methods of filling the internal cavities with the sacrificial fill material using a sleeve.

The perforating gun(s) of the present disclosure generally comprise an outer gun body which houses an inner charge tube, along which a plurality of perforating charges is disposed for detonation and subsequent perforating of the casing. As mentioned, a tremendous amount of pressure is generated during detonation due to the high amounts of hot, expanding gas that is a product of the detonation which results in substantial hoop stress exerted on the tubular members (i.e., gun body, charge tube, etc.) of the perforating gun. This hoop stress may be so high as to exceed the yield strength of these tubular members, causing them to deform, warp, or crack. In extreme cases, the tubular members may become so deformed that they are impossible to remove from the wellbore, thereby obstructing future wellbore operations through the failure zone where the tubular members are irretrievably lodged. Historically, it has often been necessary to seal off the failure zone and then drill a another well ("sidetrack") branching off from the failure area of the wellbore to salvage the well. In other cases, the wellbore is totally unsalvageable.

Beyond mere deformation of the tubular members, this high amount of hoop stress may cause other problems as well, for example, fractures following the stress patterns where the hoop stress concentration occurs. In some cases, these fractures may extend along the gun body or charge tube in a zig zag pattern connecting adjacent stress regions, for example, along the phased angle of the charges in a perforating gun. Each charge in the perforating gun produces a jet that exits the gun wall to create a perforated hole in the gun carrier. Without being limited by theory, it is believed that these perforated holes in the gun wall may account in some examples for the observed stress concentrations at particular regions of the tool and thus the specific fracture patterns commonly observed. These fractures, while obviously compromising the integrity of the perforating gun string, may also provide escape routes for the expanding gas which effectively divert the detonation energy away from its intended target area of the casing. This results in decreased explosive energy in the desired direction, reduced penetration distance of a projectile (i.e., conical metal liner), and may even result in a failure to actually penetrate the casing. In addition, the sudden influx of wellbore fluid into the perforating gun through these fractures, e.g., due to the water hammer effect, may further contribute to the damaging of the perforating gun. In some examples, safety spacers and/or spacer guns that are used to provide lengths of non-perforated zones in the well are also subject to this sudden in-rush of pressure and associated hoop stresses.

Example embodiments disclosure herein address these and other issues by placing, in some examples, a sacrificial filler material within the one or more cavities of the perforating gun(s), effectively redistributing, or dissipating most of the misdirected pressure away from the vulnerable tubular components of the perforating gun while also reinforcing the area where the perforating charges are detonated to help isolate and contain the explosive energy within that area. This reduces the amount of hoop stress experienced by the perforating gun carrier during detonation, thereby reducing the risk of buckling failure. This also reduces the risk of fracture propagation and effectively lowers the yield strength requirement of the tubular members of the perforating gun such that, in some examples, lower-strength materials can be used without unduly compromising the gun's ability to withstand the detonation, thus lowering costs. This may also increase the likelihood that the projectile(s) will jet properly, resulting in a higher overall likelihood of success of the perforating operations. This may also reduce the risk of the perforating gun becoming stuck in the wellbore, thereby decreasing non-productive time at the worksite as well as reducing the need for fishing tools and associated personnel for failed gun retrieval. Lastly, this may reduce the risk of well abandonment or expensive remedial operations, e.g., sidetracking.

FIG. 1 is a system 100 showing a perforating tool assembly 102 in a wellbore 110 during a land-based operation. The system 100 comprises a servicing rig 108 disposed on a terrestrial surface over a wellbore 110 extending into subterranean formation 116. Wellbore 110 may be vertical, deviated, horizontal, and/or curved at one or more regions of subterranean formation 116. Wellbore 110 may be cased, open hole, contain tubing, and may generally comprise a hole in the ground, i.e., "borehole", extending any appropriate distance into subterranean formation 116. In one or more examples, one or more regions of the wellbore 110 may be secured at least in part by cement.

Servicing rig 108 may be a drilling rig, completion rig, workover rig, or other mast structure supporting work string 104. In some examples, servicing rig 108 comprises a derrick and rig floor through which work string 104 extends downwards into wellbore 110. As will be shown in FIG. 2, a wellbore may be alternatively positioned in a sea-based environment, such as on a semi-submersible platform or rig, or otherwise disposed above a sea floor at an off-shore location.

Figure 3:
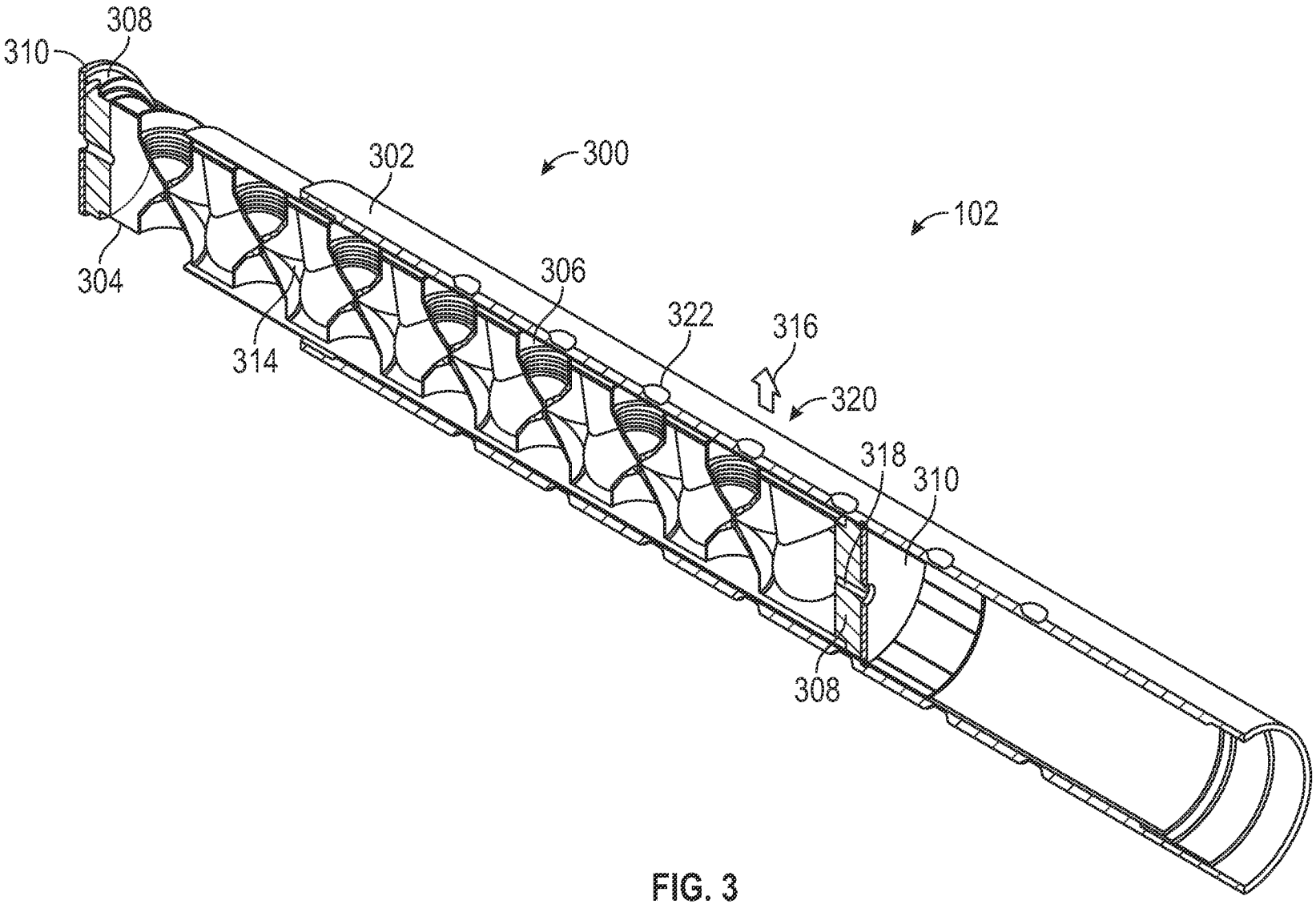
FIG. 3 is a perspective cross sectional view of a perforating gun of a perforating gun string, in accordance with some embodiments of the present disclosure.

As illustrated, work string 104 may comprise a conveyance 106 and a perforating tool assembly 102, i.e., "perforating gun string," "gun string," "perf gun assembly," or "gun assembly," comprising one or more perforating guns (e.g., perforating gun 300 of FIG. 3). In addition, work string 104 may comprise other downhole tools, such as one or more packers, one or more completion components, e.g., screens and/or production valves, one or more sensing components and/or measuring equipment, i.e., downhole sensors, and other equipment not shown in FIG. 1. In operation, work string 104 is lowered into wellbore 110 and one or more explosive charges disposed within the one or more perforating guns are detonated to perforate casing 112 to facilitate fluid communication between one or more production zones ("pay zones") 118*a*, 118*b*, 118*c*, etc., and wellbore 110.

Perforating tool assembly 102 may comprise a single or a plurality of perforating guns, which may be coupled together, for example, on a single gun string. While the present figures generally show a single, or a few perforating guns, it should be understood that perforating tool assembly 102 may comprise any suitable number of perforating guns. In one or more examples, the perforating tool assembly 102 may further comprise a firing head for initiating a detonation train to fire each of the perforating guns. In addition, the perforating tool assembly 102 may further comprise tandems, spacers, or other coupling structures for coupling together the perforating guns.

Figure 2:
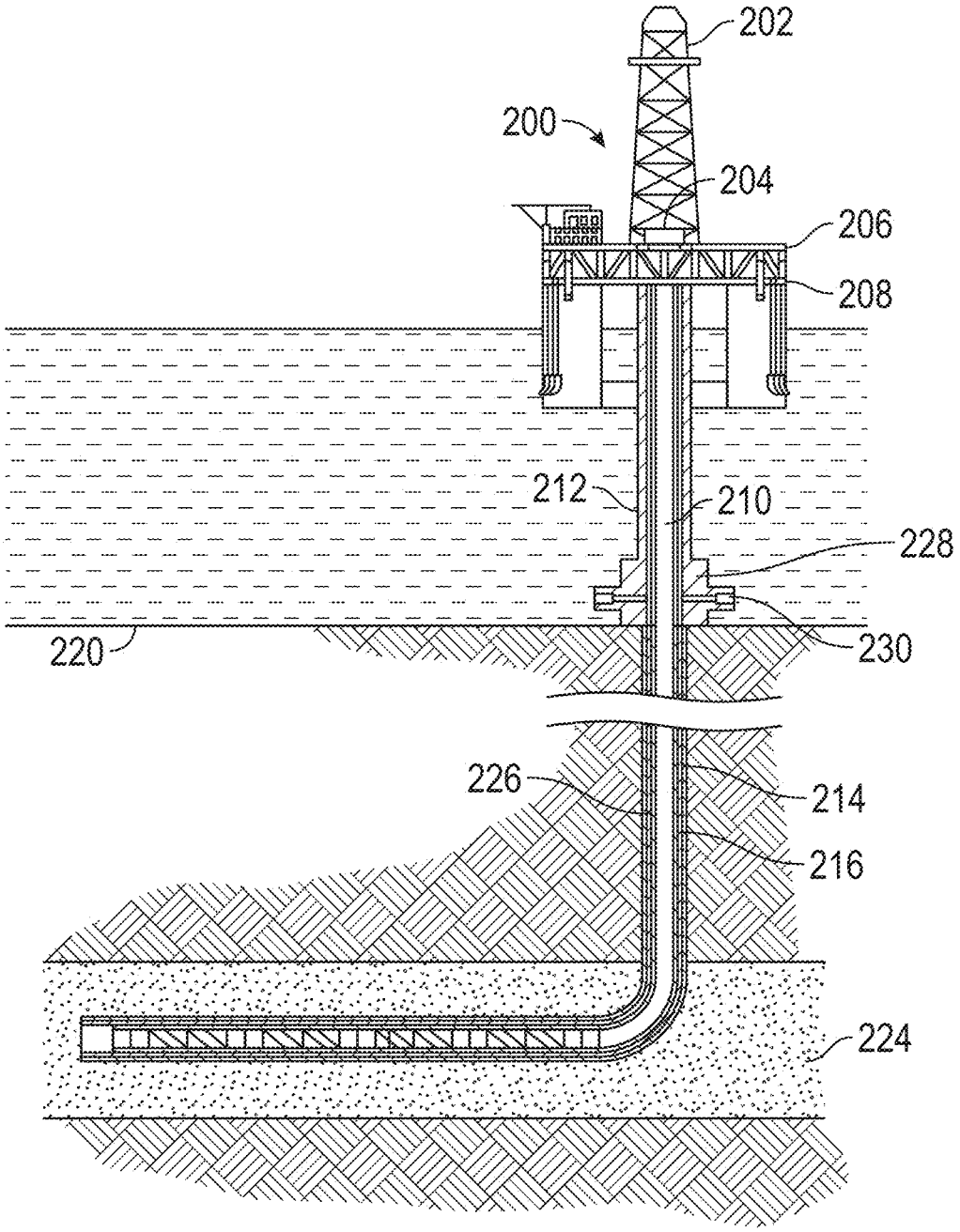
FIG. 2 is a system showing a perforating gun in a wellbore during a sea-based operation, in accordance with some embodiments of the present disclosure.

FIG. 2 is a system 200 showing one or more perforating guns 102*a*, 102*b*, 102*c*, etc., in a wellbore 214 during a sea-based operation, in accordance with some examples of the present disclosure. As mentioned, the principles shown and described with respect to perforating during land-based operations are equally applicable to sea-based operations, and vice versa.

As illustrated, a wellbore 214 may extend into a subterranean formation 224 beneath a sea floor 220. A semi-submersible platform 206 is centered over a hydrocarbon-bearing formation 224 located beneath a sea floor 220. A subsea conduit 212 extends from deck 208 of platform 206 to wellhead installation 228 which may include one or more subsea blow-out preventers 230. Platform 206 has a hoisting apparatus 204 and a derrick 202 for raising and lowering tubular strings such as work string 210.

A wellbore 214 extends through various earth strata including subterranean formation 224. Casing 226 is cemented within wellbore 214 by cement 216, as with FIG. 1. Work string 210 may be substantially identical to work string 104 (e.g., referring to FIG. 1), except that it is adapted for a subsea environment. In operation, work string 210 is similarly lowered through casing 226 until one or more perforating guns of work string 210 reach a desired depth. Thereafter, the explosive charges are detonated to perforate casing 226. In either of FIG. 1 or 2, detonation may occur in either a down-going (downhole) or an up-going (uphole) fashion. As shown, work string 210 comprises one or more perforating guns 102*a*, 102*b*, 102*c*, 102*n* which may be joined together during, for example, tubular make-up of the gun string.

FIG. 3 is an exploded cross-sectional perspective view of a perforating tool assembly 102 comprising a perforating gun 300 to show the internal part of the perforating tool assembly 102, in accordance with one or more embodiments of the present disclosure. As illustrated, perforating tool assembly 102 comprises at least one perforating gun 300 which is shown as comprising various tubular and non-tubular members which are disposed within a gun body 302. Gun body 302 may also be referred to as a "gun carrier" in this context, whereby it possesses the ability to carry or house the other members of the perforating gun 300. These various tubular and non-tubular members comprise, for example, a charge tube 304 extending along the gun body 302, a plurality of perforating charge cases 306 and their associated charges (e.g., shaped charges), end alignment(s) 308, end pieces 310.

The charge tube 304 is held in place within the gun body 302 by one or more (e.g., two) end alignments 308, which are shown as being disposed at opposite ends of the charge tube 304. The charge tube assembly, which comprises a charge tube 304 and perforating charge(s) (e.g., perforating charges 602 of FIG. 6), as well as the pair of end alignments 308, may be book-ended by one or more end pieces 310 in some examples. The end pieces may serve to cap either end of each perforating gun 300 and may come serve to facilitate filling the inner cavity 314 of the charge tube 304 with the sacrificial fill material 702, to be shown and described in subsequent figures (e.g., FIG. 9).

The charge cases 306 are configured to house perforating charges (not shown) and one or more projectiles (i.e., conical metal liners). The charge cases 306 also have a substantially conical profile, as illustrated, for directing the explosive energy of the perforating charges in a firing direction 316 schematically illustrated by the arrow in FIG. 3. Subsequent to detonation of a detonating cord (e.g., detonating cord 502 of FIG. 5), the perforating charges may be detonated in a serial fashion along the length of the charge tube 304, forming hot, expanding gas which causes the "metal liners (e.g., conical metal liner 604 on FIG. 6) to invert before blasting through the gun body 302 and jetting, i.e., hydrodynamically pushing, through the casing 112, 226 and into the formation 116, 224 (e.g., referring to FIGS. 1 and 2). This opens the wellbore 110, 214 to the formation 116, 224 (e.g., referring to FIGS. 1 and 2), allowing free fluid communication between the wellbore 110, 214 and the reservoir.

The end alignments 308 and end pieces 310 have a centerline hole and feedthrough 318 that allow a detonating cord (e.g., detonating cord 502 of FIG. 5) to feed through. In operation, the detonating cord may be linked to each charge case such that the detonation proceeds in a downhole fashion from a firing head. Alternative configurations are possible, for example, wherein detonation proceeds in an uphole fashion. The end alignments 308 and/or end pieces 310 may also function to align the charge tube 304 at a specific orientation within the gun body 302 to ensure, for example, that the firing direction 316 of each perforating gun 300 corresponds to one or more reduced wall thickness sections 320 of the gun body 302, e.g., at the scallops 322 formed within the gun body 302. Scalloped guns are currently the most common in the industry, although slickwall guns, i.e., guns that are not scalloped, are also used. Scallops reduce wall thickness to reduce the possibility of burrs which would extend beyond the perforating gun's 300 outer diameter. This helps to avoid damage to the interior of the well and its associated equipment during retrieval of the gun after detonation. The teachings and principles provided herein are applicable to both scalloped and non-scalloped types of guns. One primary purpose of the end alignments 308 is, in some examples, to ensure that the charge tube 304 does not physically contact the gun body 302. End alignments 308 may also house other components of the perforating gun 300, such as the detonator (not shown), for example.

Figure 4:
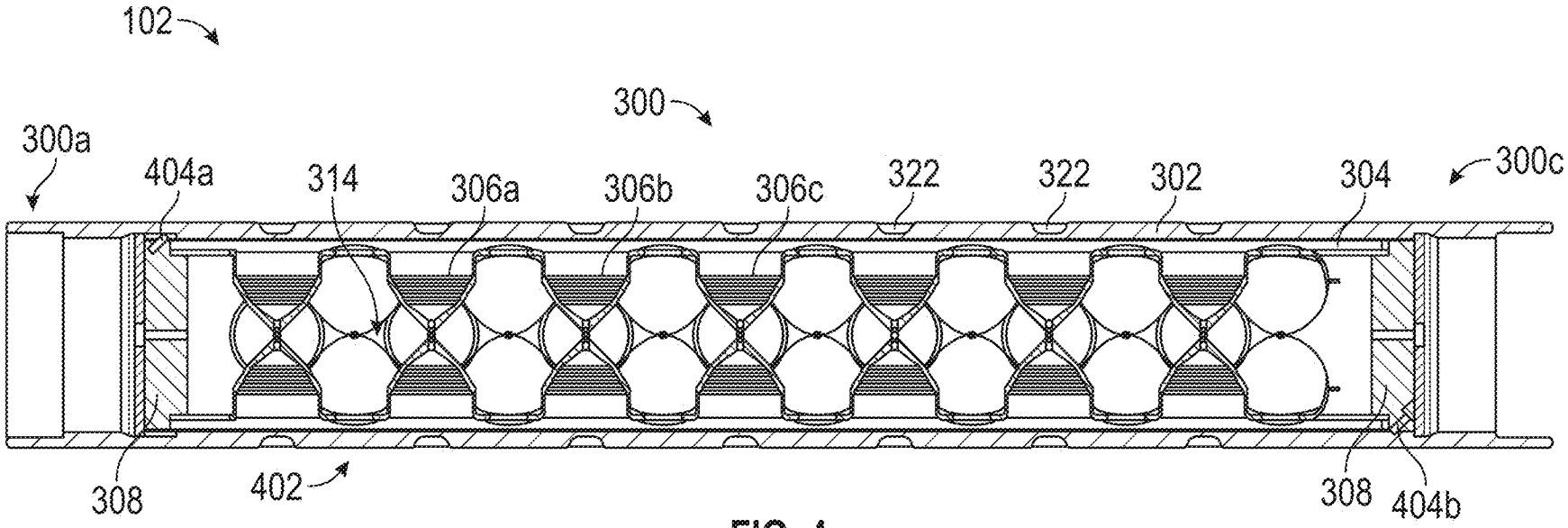
FIG. 4 is a cross sectional side view of the perforating gun of FIG. 3, in accordance with some embodiments of the present disclosure.

FIG. 4 is a cross sectional side view of the perforating gun 300 of FIG. 3, except that it is shown as being disposed between second (downhole) and third (uphole) perforating guns 300*a*, 300*c*. As illustrated, the perforating gun 300 comprises a plurality of charge cases 306*a*, 306*b*, 306*c*, etc. which may form quadrantal sets 402 arranged in a linear fashion along the central axis of the perforating tool assembly 102, as illustrated. In the illustrated example, the charge cases 306 which would be oriented out of the plane (i.e., coming out of the page) are omitted for reference. Alternative configurations are possible, for example, non-quadrant orientations having more or less than four charge cases 306*a*, 306*b*, 306*c* per set 402 (e.g., three, five, six, etc.), depending on the thickness and/or inner diameter of the casing 112, 226 (e.g., referring to FIGS. 1, 2), desired perforation density, and/or desired penetration depth of the projectiles into the formation. Each set 402 of charge cases may be linearly arranged, as shown, or may be offset from each other to allow more narrow packing of the charge cases 306*a*, 306*b*, 306*c* and thus a greater number of charge cases 306*a*, 306*b*, 306*c* per length of charge tube 304. It should be understood that other arrangements of charge case 306 may be used instead of (or in addition to) the arrangement shown in FIG. 4, and that FIG. 4 is merely one example for purposes of illustration.

As illustrated, one or more set screws 404*a*, 404*b* may be used to secure the end alignments 308 and/or the charge tube 304 within the gun body 302. In the illustrated embodiment, at least two set screws 404*a*, 404*b* are used for each perforating gun 300, with a first set screw 404*a* at a downhole end of the perforating gun 300 and a second set screw 404*b* at an uphole end of the perforating gun 300 opposite and diagonal to the first set screw 404*a*. The set screws 404*a*, 404*b* may serve to limit the mobility of the charge tube 304 relative to the end alignment 308 and/or gun body 302. Alternative set screw configurations are possible, for example, with one or more radially oriented (i.e., perpendicular to the central axis of the perforating gun 300) set screws in addition to, or instead of, set screws 404*a*, 404*b*, for example, opposite those shown in FIG. 4 on the end alignment 308.

The scallops 322 primarily serve to provide a recessed outer surface to limit the extension of burrs beyond the outside diameter of the gun carrier. As such, the scallops result in weakened areas of the gun body 302. As mentioned, this allows the high pressure expanding gases of the detonated charges to hydraulically push one or more metal liners (e.g., conical metal liner 604 referring to FIG. 6) radially outwards from the charge cases 306*a*, 306*b*, 306*c* and out through the gun body 302. Weakening the gun body 302 at these areas ensures that the path of least resistance for the explosive energy is in the firing direction 316. Subsequent to detonating of the perforation charges, the metal liner inverts during the process, thereby forming a projectile that jets out through the casing 112, 226 (e.g., referring to FIGS. 1, 2) and into the formation. The specific orientation of the scallops 322 along the gun body 302 may vary, for example, wherein a single scallop 322 is associated with each charge. Placement of the end alignment(s) 308 and/or set screws 404*a*, 404*b* at the correct orientation may, in some examples, ensure that the firing directions associated with each charge case line up with the corresponding weakened portion(s) of the gun body 302. In some examples, the end alignment 308 may be configured such that it allows a limited number of (e.g., one) acceptable orientations of the charge tube 304 relative to the gun body 302.

Figure 5:
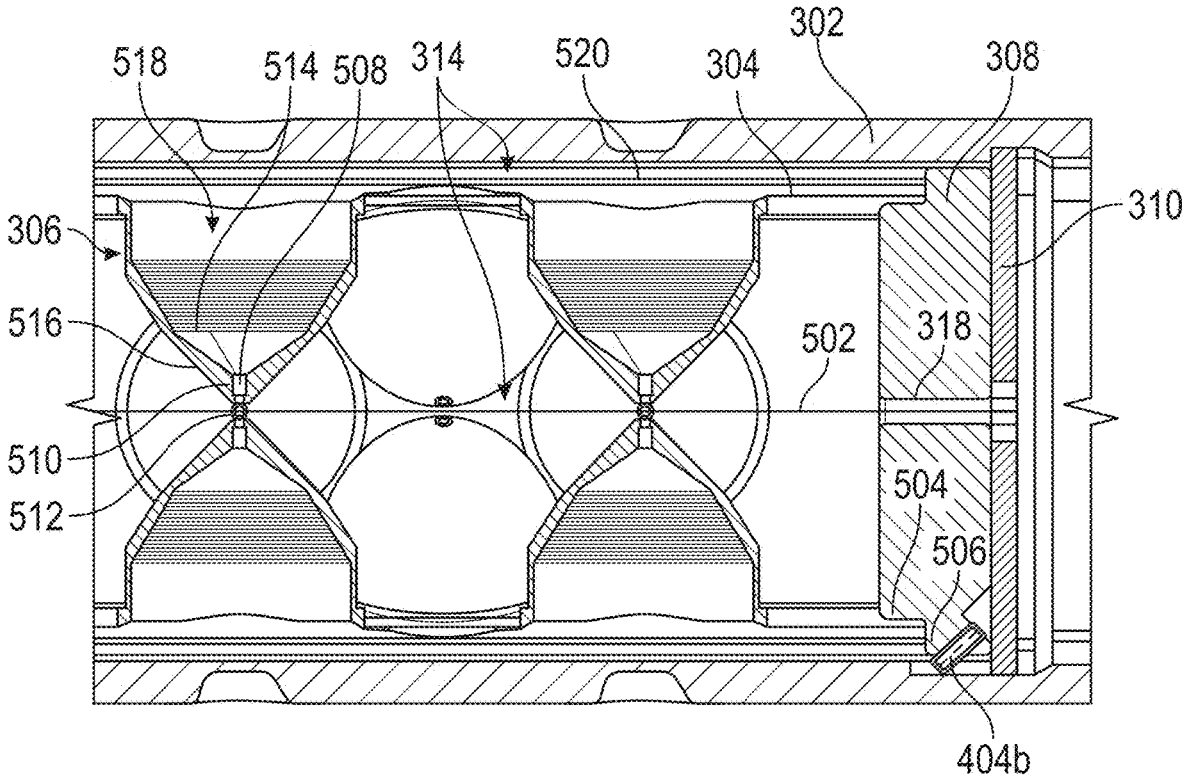
FIG. 5 is an enlarged cross sectional side view of the perforating gun of FIG. 4 to show the detonating cord, in accordance with one or more embodiments of the present disclosure.

FIG. 5 is a close-up view of FIG. 4, which shows the detonating cord 502 routed along the centerline of the perforating gun 300, in accordance with one or more embodiments of the present disclosure. Visible in this figure is the detonating cord 502 extending from the centerline hole and feedthrough 318 of the end piece 310 and end alignment 308, along the length of the charge tube 304, and in the downhole direction. Also visible is the second set screw 404*b*, which locks the end alignment 308 to the gun body 302, e.g., without physically contacting the charge tube 304. The end alignment 308, part of which is shown as being seated within the charge tube 304, may limit movement of the charge tube 304 in the axial direction as well as in the differential (i.e., tangential to the circumference) direction of the charge tube 304.

As illustrated, the end alignment 308 comprises a generally tubular body having at least a narrow portion 504 and a wider portion 506. The narrow portion 504 may conform to an inner (or outer) diameter of another tubular member of the perforating gun 300, e.g., the inner diameter of the charge tube 304 in the illustrated example. The wider portion 506 may also conform to an inner diameter of a tubular member of the perforating gun 300, e.g., the inner diameter of the gun body 302 in the illustrated example. This view also shows the detonating cord feedthrough 318 of the end alignment 308 as well as the detonating cord feedthrough 318 of the end piece 310. In the illustrated example, both the feedthrough 318 and centerline hole are oriented along the central axis of the perforating tool assembly 102 (e.g., referring to FIG. 1), and by extension, the central axis of the gun body 302, charge tube 304, end alignment 308, and end piece 310. This specific configuration may, in some examples, ensure that the detonating cord 502 is sheltered from external influences (e.g., the wellbore 110, 214, wellbore fluid, etc.). Such placement may, in some examples, also allow for the detonation to propagate more rapidly along the length of the charge tube 304 than what could be achieved in other configurations, which may be a desired characteristic for longer types of guns (e.g., 22', or greater than 15' (4.6 meters), as measured between end alignment 308 and end alignment 308). Rapid detonation of the detonating cord (i.e., relative to the detonating of the perforating charges) may ensure that the traveling detonation along the detonating cord is unhindered by pressure waves, influx of wellbore fluids, or other effects associated with detonating of the perforating charges. For example, use in this manner may prevent or reduce the likelihood of incomplete detonation of the detonation train.

Other configurations for the detonating cord are also possible. For example, rather than the detonating cord feedthrough 318 being positioned along the central axis of the perforating gun 300, the detonating cord 502 may instead be wrapped helically around the charge tube 304, fed through a non-centerline hole of the end alignment 308 and end piece 310, or configured in any suitable fashion to detonate the perforating charges within the charge cases 306. In yet alternative configurations, rather than relaying the detonation signal along the detonating train directly with the detonating cord, one or more signal conductors (e.g., flexible wire, ribbon, electric trace, etc.) may be used. In such examples, it may be necessary to include individual detonators within each perforating gun 300, where each detonator ignites a separate detonating cord corresponding to each perforating gun.

An opening 508 may be disposed at the vertex 510 of each charge case 306, as illustrated. This allows the detonation of the detonating cord 502 to trigger explosions of the perforating charges nested within the charge cases 306. Near or at the center line of the perforating gun 300 near or at the openings 508 of each of the charge cases 306, an explosive initiator 512 may be disposed to ensure good detonation of each perforating charge and to reduce the risk of incomplete detonation. An explosive initiator 512 may be as simple as an added amount of explosive material. Alternatively, the explosive initiator 512 may comprise, for example, a primary explosive and a secondary explosive. Where used, the primary explosive may be extremely sensitive to stimuli, such as to an electrical signal. The secondary explosive may be a larger quantity of a less sensitive explosive material triggered by the primary explosive. Any suitable explosive material can be used, as a variety of explosive materials for use in various detonating systems is generally available. In one or more examples, the explosive initiator 512 may comprise a shell (not shown), wherein an explosive material is disposed within the shell.

As illustrated, each charge case 306 has an interior conical surface 514 and an outer surface 516. As previously mentioned, the charge case 306 houses the perforating charge and the conical metal liner. Outside the charge case 306 and between charge cases 306 is the inner cavity 314 of the charge tube 304, to be filled with the sacrificial fill material 702 (e.g., sacrificial fill material 702, referring to FIG. 7).

Inner cavity 314 may be generally characterized as the space(s) within the charge tube 304 between the charge cases 306. Specifically, the "inner cavity" is defined as any one or more region(s) within the charge tube that is not directly contiguous with a perforating charge. It is noted that while empty spaces may exist within other regions of the charge tube 304, for example, the interior space 518 of each charge case 306 which would be at least partially occupied by or otherwise house the perforating charges, the "inner cavity" does not include these spaces. As will be made clear later in this disclosure, filling the interior space 518 of each charge case 306 with material would depreciate the charge performance as the material would interfere with collapsing/inverting of the conical liner that forms a penetrating jet. Stated simply, this would inhibit the jet formation or result in a less effective jet as some of the energy would be redirected to forming an intermittent jet pushed into the conical liner. As will be discussed in greater detail, methods in accordance with the present disclosure involving applying a sleeve (e.g., sleeve 520 of FIG. 5) to cover the charges creates an intentionally sealed off cavity, i.e., interior space 518, to ensure jet formation and subsequent satisfactory launching of the projectile. In some examples, the "inner cavity" may refer to "one or more inner cavities," for example, in embodiments where the inner cavity is subdivided into one or more subregions (not shown). It should also be understood that the detonating cord 502 which does indeed comprise, in examples, an explosive material and which may be disposed within the inner cavity and thus "contiguous" with the inner cavity, is not to be considered a "perforating charge" in the context of determining whether or not the space housing the detonating cord is interpreted as being contiguous or not contiguous with a perforating charge. Similarly, any apparent contiguity between the perforating charge at least partially housed by each charge case 306 and the inner cavity 314 through the opening 508 for allowing communication between the detonating cord 502 and the perforating charge should not be considered "contiguity" in the sense that it is sufficient to render the space(s) as not being an "inner cavity," in accordance with the present disclosure. In the illustrated example, inner cavity 314 also comprises the space between sleeve 520 and the gun body 302. To state it more generally, inner cavity 314 may, in addition or as an alternative to other void spaces of the gun, comprise one or more empty spaces disposed between the charge tube 304 and the gun body 302.

Figure 6:
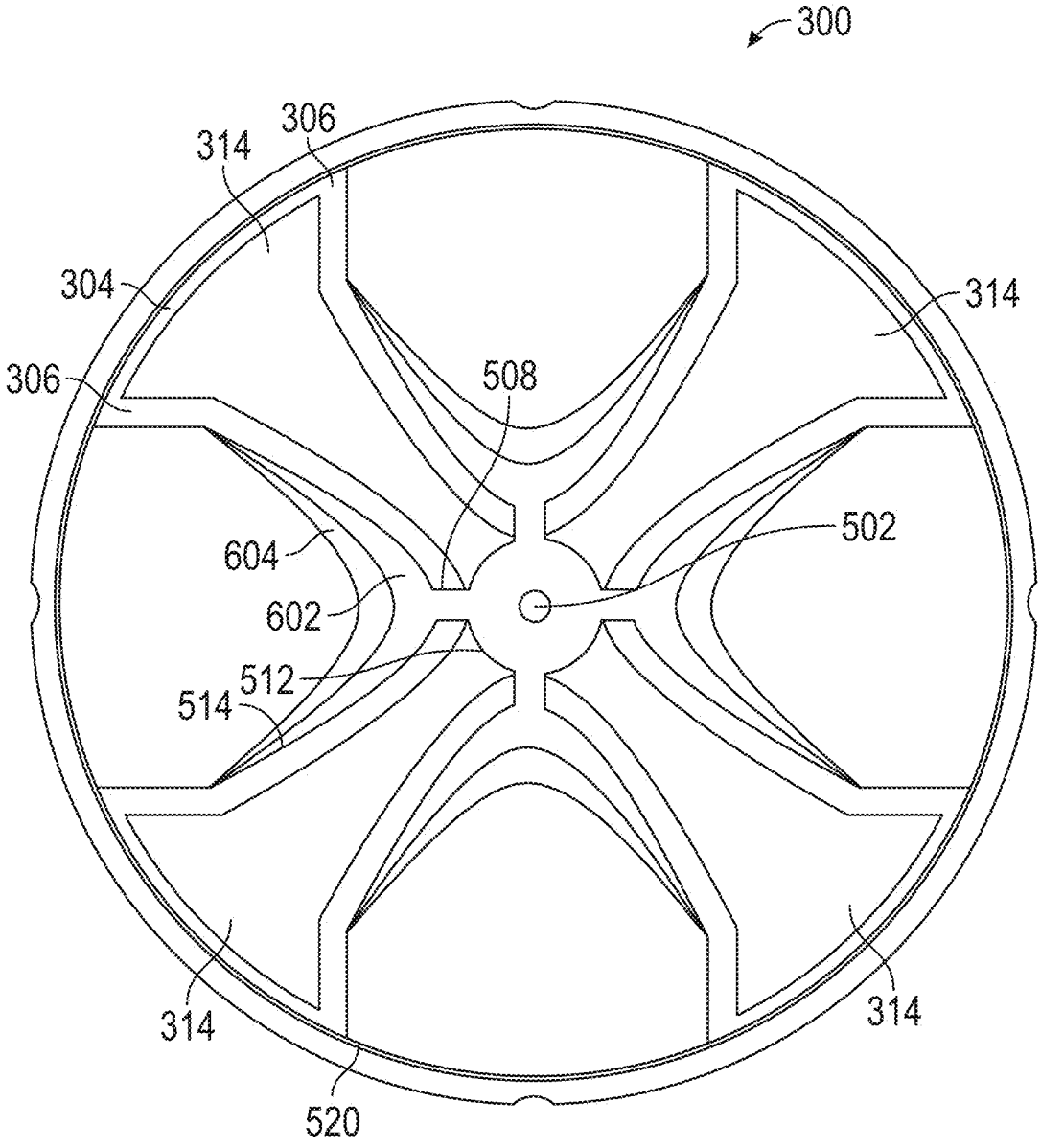
FIG. 6 is a cross sectional end view of the perforating gun of FIGS. 3-5 to show cavity, in accordance with some embodiments of the present disclosure.

FIG. 6 is a downhole cross sectional view of the perforating gun 300. This view shows a quadrantal set 402 (e.g., referring to FIG. 4) of charge cases 306 which are installed within the charge tube 304 and radially aligned relative to the central axis of the perforating gun 300, in accordance with one or more embodiments of the present disclosure. At the center point of the charge tube 304 is the detonating cord 502, which may be proximate to and/or housed within an explosive initiator 512. The openings 508 of the charge cases 306 are also shown, which allow for communication between the detonating cord 502 and a perforating charge 602. As illustrated, the perforating charge 602 is disposed between the interior conical surface 514 of the charge case 306 and the conical metal liner 604. Also visible in this figure is the gun body 302 disposed about the charge tube 304, as well as the one or more scallops 322 formed within the gun body 302. The inner cavity 314 of the charge tube 304 is also shown. As mentioned, this space may be filled with sacrificial fill material 702, to be shown and described in subsequent figures. Also visible in this figure is the sleeve 520 disposed about the charge tube 304 and charge cases 306, with the gun body 302 disposed about the sleeve 520, as well as, the inner cavity 314. While shown at different regions of the figure, the inner cavity 314 may comprise a single, continuously formed void space disposed within the charge tube 304.

Figure 7:
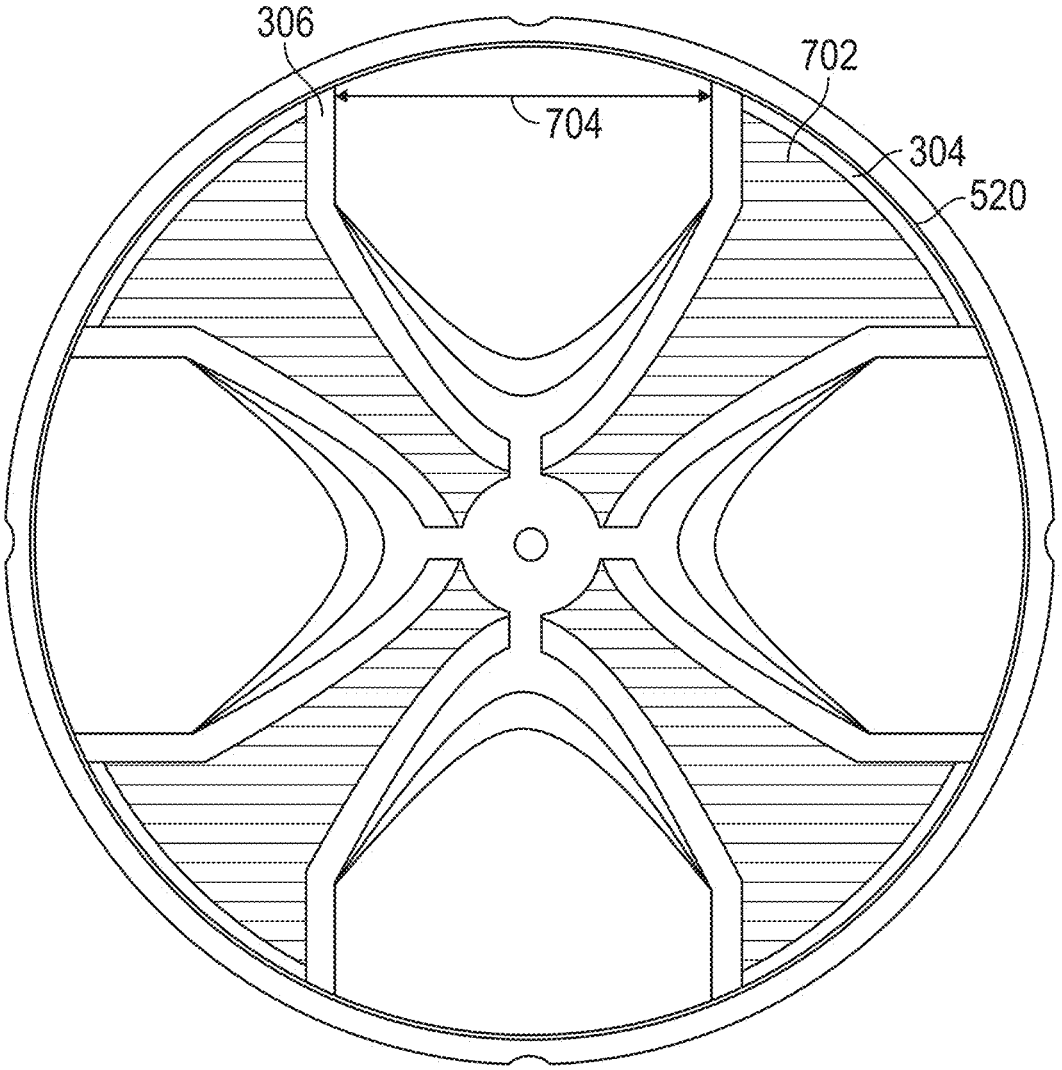
FIG. 7 is the cross sectional end view of the perforating gun of FIG. 6 with the cavity filled with sacrificial fill material, in accordance with one or more embodiments of the present disclosure.

FIG. 7 is identical to FIG. 6, except that the sacrificial fill material 702 is disposed within at least a portion of the inner cavity 314 (e.g., referring to FIGS. 3-6) of the charge tube 304. The sacrificial fill material 702 may comprise various materials, for example: one or more polymers; one or more viscoelastic materials; various foam(s), such as a compressible foam, rigid foam, semi-rigid foam, liquid expanding foam, solid foam, polyurethane foam, polystyrene, polyethylene, polypropylene, silicone, melamine-formaldehyde, natural latex, ethylene-vinyl acetate, phenolic resin, etc.; solid materials such as spheres (e.g., glass spheres), balls, rubber, etc.; various sacrificial fluids; resins; combinations thereof; or the like. In addition, the sacrificial fill material 702 may comprise one or more liquid absorbent materials such as sodium polyacrylate.

In addition, the composition of the sacrificial fill material 702 may be specifically engineered to optimize one or more of its material properties. Material properties include, for example, bulk modulus, viscoelasticity, density, etc. For example, the composition of the sacrificial fill material 702 may be engineered such that it has a bulk modulus between about 1 megapascal and about 40 gigapascals, or any ranges therebetween. One example technique for tuning the composition to a specific material property is to incorporate spheres, balls, and/or fluid into the sacrificial fill material 702, which increases or decreases the density of the sacrificial fill material 702. In some examples, modifying the density of the sacrificial fill material 702 may be achieved by varying the amount of water in the sacrificial fill material 702.

In one or more examples, the sacrificial fill material has a density from about 10 kilograms (kg) per cubic meter ($m^3$) to about 1000 kilograms per cubic meter. Alternatively, from about 10 $kg/m^3$ to about 20 $kg/m^3$, about 20 $kg/m^3$ to about 40 $kg/m^3$, about 40 $kg/m^3$ to about 60 $kg/m^3$, about 60 $kg/m^3$ to about 100 $kg/m^3$, about 100 $kg/m^3$ to about 150 $kg/m^3$, about 150 $kg/m^3$ to about 250 $kg/m^3$, about 250 $kg/m^3$, to about 500 $kg/m^3$, about 500 $kg/m^3$ to about 1000 $kg/m^3$, or any ranges therebetween.

The sacrificial fill material 702 may comprise a hardenable or a settable material, such as a liquid or slurry that chemically reacts (e.g., hydration, polymerization, gelation, cross-linking, crystallization, deposition, etc.) to form a solid. The sacrificial fill material 702 may be homogenous or heterogeneous. At least a portion of the sacrificial fill material 702 may be first applied as a solid, a liquid, a foam, or any combination thereof. The sacrificial fill material 702 may be non-degradable, or alternatively, degradable. The sacrificial fill material 702 may be compact, or alternatively, free-flowing.

Also illustrated is the sleeve 520, which is shown as encompassing a whole outer diameter of the charge tube 304. The sleeve 520 may comprise, to use non-limiting examples, a film, fabric, wrap, tape, plastic, shrink wrap, tarp, paper, cloth, sheet, organic material (e.g., wood, etc.), polymer, combinations thereof, or the like. Alternatively, or additionally, the sleeve 520 may comprise one or more impact-resistant materials including Kevlar, twaron, technora, heracron, alkex, polyethylene, rubber, metallic mesh, combinations thereof, or the like, to use non-limiting examples. Advantages associated with using an impact-resistant material include, for example, the ability to absorb energy from the detonation to dissipate the energy from the expanding gases and thus reduce pressure experienced by certain regions of the perforating tool assembly 102.

Properties of the sleeve 520 may include, without limitation: flexibility; adhesiveness; elasticity or inelasticity; permeability, semi-permeability, or impermeability; high or low impact resistance; and any materially feasible combination thereof.

In alternative examples, the sleeve 520 may only partially cover the charge tube 304. For example, the sleeve 520 may selectively encase specific regions of the charge tube 304. For example, the outer opening 704 of one or more of the charge cases 306, schematically shown at 704 by a solid line, may be left closed by the sleeve 520. This may be accomplished, for example, by having the sleeve 520 comprise one or more cut-out sections (not shown), configured to cover or leave open select regions (e.g., the outer opening 704) of the charge tube 304. Where the sleeve 520 comprises one or more impact resistant materials, for example, it may be desirable to not cover the charge cases so that the firing direction 316 (e.g., referring to FIG. 3) is left unhindered when jetting of the conical metal liner subsequent to detonation of the perforating charge(s) 602 (e.g., referring to FIG. 6).

Figure 8:
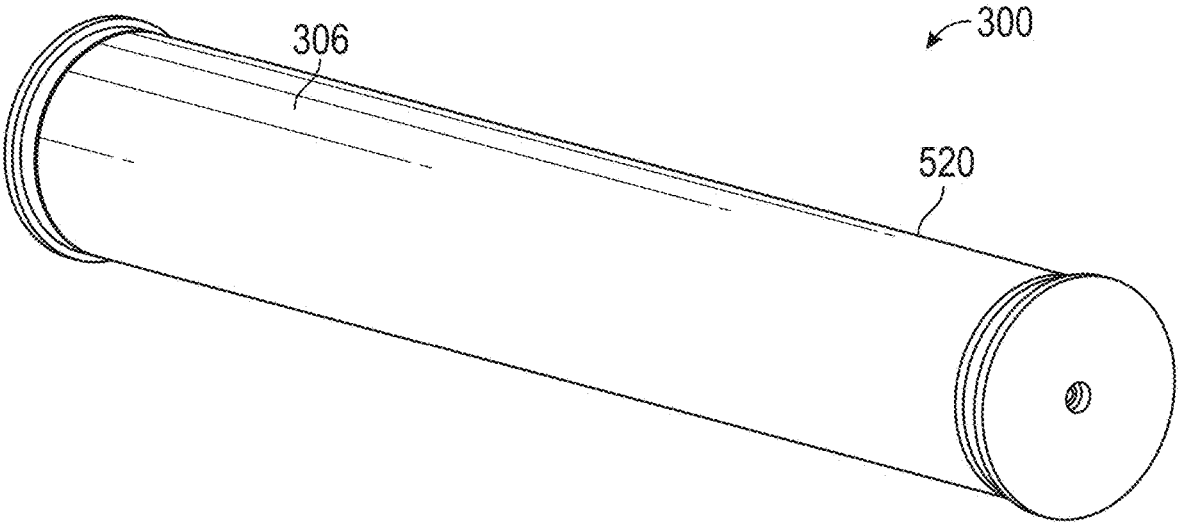
FIG. 8 is a perspective view of the perforating gun of FIG. 3 with the gun body omitted for reference to show a sleeve, in accordance with one or more embodiments of the present disclosure.

FIG. 8 is a perspective view of a perforating gun 300 with the gun body 302 (e.g., referring to FIG. 3) omitted for reference to show the sleeve 520 disposed about the charge tube 304, in accordance with one or more embodiments of the present disclosure. As mentioned, the sleeve 520 may be circumferentially disposed about the charge tube 304. In this view, the sleeve 520 is shown as being disposed about a substantial portion of (e.g., entirety of) the outer surface area of the charge tube 304. Advantages of this may include, in some examples, ergonomic assembly, as it may be easier to wrap the charge tube than to section off specific portions only. Prior to or during tubular make-up of a perforating tool assembly 102 (e.g., referring to FIG. 1), the sleeve 520 is wrapped around the charge tube 304. The charge tube 304 may be fully loaded with perforating charge(s) 602 and a conical metal liner 604 (e.g., referring to FIGS. 6, 7) prior to applying the sleeve 520 about the charge tube 304, or alternatively, may be loaded thereafter. The sacrificial fill material 702 (e.g., referring to FIG. 7) may be introduced into the inner cavity 314 (e.g., referring to FIGS. 3-6), for example, before finally being installed within the gun body 302.

Figure 9:
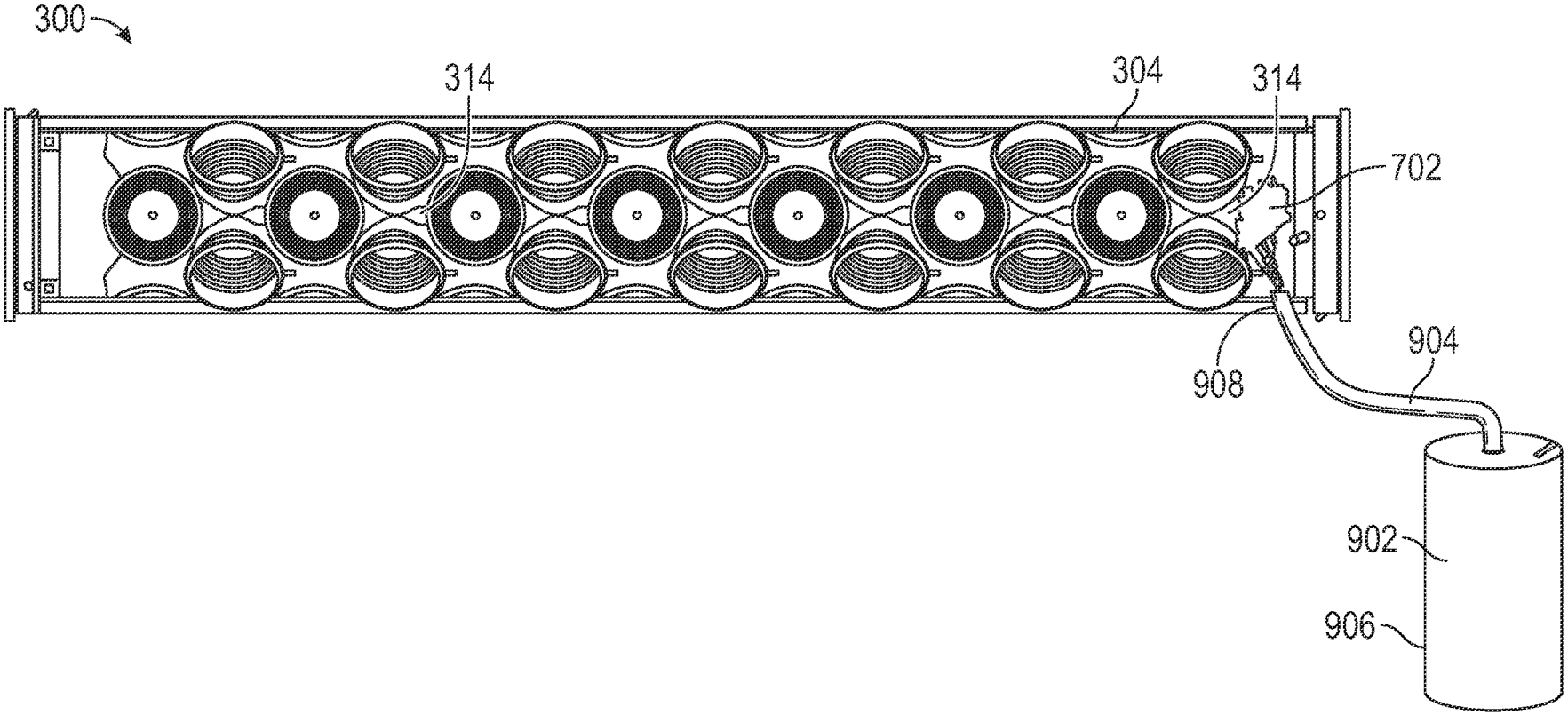
FIG. 9 is a schematic illustration of a source of sacrificial fill material for filling the cavity with sacrificial fill material, in accordance with one or more embodiments of the present disclosure.

FIG. 9 is a schematic illustration showing a source 902 of the sacrificial fill material 702 in fluidic communication with the inner cavity 314 of the charge tube 304 by a hose 904, in accordance with one or more examples of the present disclosure. The sacrificial fill material 702 may be introduced to the inner cavity 314 in various manners (e.g., spraying, pumping, flowing, gravity flowing, injecting, siphoning, centrifugation, vacuuming, conveying, pneumatic transport, casting or molding, hydraulic pressure, etc.). In examples, the sacrificial fill material may be flowable (e.g., liquid and/or solid) at the time of introduction into inner cavity 314. Alternatively, at least a portion of the sacrificial fill material 702 may be non-flowable, solid, and/or rigid. For example, the sacrificial fill material 702 may include solids, semi-solids, and/or highly viscous substances that resist flow. In the illustrated example, however, the sacrificial fill material 702 comprises a flowable material that is introduced into the inner cavity 314 through one or more hoses, shown in the present figure as a single hose 904. Such a hose 904 may be used to fluidically connect a source 902 of the sacrificial fill material 702 to the source 902. As illustrated, the source 902 is disposed within a vessel 906, which may be, for example, one or more pressure vessels. Alternatively, one or more containers, one or more bags, one or more vats or pans, one or more casks or barrels, one or more tanks, one or more mixers (e.g., agitators, blenders, paddle mixers, shear mixers, static mixers, homogenizer, turbine mixer, drum mixer, screw mixers, double cone mixers, fluidized bed mixers, sigma blade mixers, vortex mixers, batch mixers, in-line mixers, air-driven mixers, etc.) one or more tubes or pipelines, one or more flexitanks, one or more drums, one or more silos, any combinations thereof, or any other suitable vessel for containing a flowable material. While not illustrated, one or more pumps, flow meters, pressure gauges, temperature gauges, sensors, or similar device may be coupled with (e.g., in fluidic communication with) the sacrificial fill material 702 as it is introduced into the inner cavity 314, such as by being coupled to hose 904, source 902, charge tube 304, or any one or more regions therebetween.

Hose 904 may comprise one or more flexible conduits, e.g., tubes, of any suitable diameter. Alternatively, one or more rigid conduits, such as one or more pipes, ducts, chutes, manifolds, combinations thereof, or the like. Hose 904 may comprise, or be substituted with, any suitable apparatus for conveying sacrificial fill material 702 into the inner cavity 314. In one example, hose 904 may be replaced by or supplemented with a conveyer belt, such as when the sacrificial fill material 702 comprises one or more solids.

The sacrificial fill material 702 is conveyed from the source 902 to the inner cavity 314 of the charge tube 304, e.g., via the hose 904, as illustrated. The sacrificial fill material 702 may be conveyed into the inner cavity 314 via a single opening 908 of the charge tube 304, or multiple, e.g., two, three, four, five, etc. In one or more examples, the one or more openings 908 of the charge tube through which the sacrificial fill material 702 is conveyed during filling of the inner cavity 314 may comprise (i) the one or more openings 508 (e.g., referring to FIG. 5) of the charge case 306 (ii) the feedthrough(s) 318 of one or more end alignment(s) 308 and/or (iii) centerline hole(s) of one or more end pieces 310 (e.g., referring to FIG. 3).

Where used, the sleeve 520 serves to contain the sacrificial fill material 702 within the inner cavity 314 such that filling of the inner cavity 314 does not overfill the inner cavity 314. Sleeve 520 may also prevent the sacrificial fill material 702 from migrating to unwanted regions of the gun. In operation, the inner cavity 314 is filled until a substantial portion of the inner cavity is occupied by the sacrificial fill material 702. As used herein, a substantial portion is defined to mean a majority (e.g., greater than 50%, greater than 60%, greater than 70%, greater than 80%, greater than 90%) of the inner cavity 314, or alternatively, an entirety (e.g., approximately 100%) of the inner cavity 314.

Filling of the inner cavity 314 with the sacrificial fill material 702 may occur prior to, or after, any of disposing of the detonating cord 502 (e.g., referring to FIG. 5) within the charge tube 304, disposing of the charge tube 304 within the gun body 302, disposing of the end alignment 308 and/or end pieces 310 at one or both sides of the charge tube 304, disposing of the perforating charge(s) 602 (e.g., referring to FIG. 6) and/or conical metal liner(s) (604) within one or more of the charge cases 306, or any mechanically feasible combination thereof. In one embodiment, for example, the sacrificial fill material 702 solidifies within the inner cavity 314, after which the ensuing solidified material is removed (e.g., drilled out) to make room for installing of the detonating cord (e.g., detonating cord 502 of FIG. 5). In another embodiment, for example, the detonating cord may be installed within the charge tube 304 prior to filling of inner cavity 314 with the sacrificial fill material 702 or else installed after the filling of inner cavity 314 but prior to solidifying of the sacrificial fill material 702.

In one or more examples, filling of the inner cavity 314 may be performed in multiple stages. For example, a first stage may comprise filling with a first stage fill material, and a second stage may comprise filling with a second stage fill material. The first stage fill material may comprise, for example, one or more solids (e.g., balls, glass, spheres, etc.), with the second stage fill material comprising one or more flowable materials (e.g., liquid, foam, slurry, etc.). The second stage fill material may, in some examples, be relatively more flowable than the first stage sacrificial fill material 702. In other examples, an earlier stage may comprise filling a first region of the inner cavity 314 (e.g., inside the charge tube), wherein a later stage comprises filling one or more additional regions (e.g., between charge tube and gun body) of the inner cavity 314.

As mentioned previously, after filling the inner cavity 314 with the sacrificial fill material 702, the sleeve 520 may or may not be removed. For example, in embodiments where the sacrificial fill material 702 comprises a hardenable or settable material (e.g., gellable material, hardenable foam, etc.), the sacrificial fill material 702 may at least partially solidify before removing the sleeve 520. In other examples, the sleeve 520 is not removed, but installed within the gun body 302 along with the charge tube 304, as shown in FIG. 7. In such examples, the conical metal liners may perforate through the sleeve 520 when jetting out into the formation.

An example procedure for assembling one or more loaded charge tube subassemblies is provided. As used herein, a "charge tube subassembly" comprises at least one charge tube (e.g., charge tube 304 of FIG. 3), end alignments and/or end pieces (e.g., 308, 310 of FIG. 3), charge cases (e.g., charge case 306 of FIG. 5), and shaped charges (e.g., perforating charge(s) 602 of FIG. 6), and does not comprise a gun body (e.g., gun body 302 of FIG. 3). Assembly of the charge tube subassembly may comprise securing end alignments and/or end pieces at either end of the charge tube. Charge cases are installed within openings (e.g., circular/patterned cut-outs) of the charge tube 304. Charges (e.g., perforating charge(s) 602 of FIG. 6) are then loaded into the charge cases 306. Following placement of the charges, metal liners (e.g., conical metal liner 604 of FIG. 6) are placed within the plurality of charge cases. The charge tube subassembly may then be wrapped with a sleeve (e.g., sleeve 520 of FIGS. 6-8) and disposed within a gun body (e.g., gun body 302 of FIG. 3) to form a perforating gun (e.g., perforating gun 300 of FIG. 3). The sacrificial fill material 702 may be introduced to the inner cavity 314 before and/or after disposal of the loaded charge tube subassembly into the gun body 302.

An example procedure for assembling one or more perforating guns 300 of the perforating tool assembly 102 (e.g., referring to FIG. 1) is also provided. One or more charge tube subassemblies are assembled, e.g., according to the example procedure provided above. A detonating cord (e.g., detonating cord 502 of FIG. 5) may be disposed in the charge tube 304 before or after make-up of the charge tube subassembly. A sleeve (e.g., sleeve 520 of FIG. 6-8) is disposed about the charge tube, for example, prior to disposal of the subassembly into the gun body. Hose 904 is connected to a source 902 of the sacrificial fill material 702 and is inserted into the inner cavity 314 of the charge tube 304 via one or more openings of the charge tube 304. A substantial portion of the inner cavity 314 is filled with the sacrificial fill material 702. The sacrificial fill material 702 sets within the inner cavity 314. The charge tube 304 now includes the set sacrificial fill material 702, and once disposed and fitted within the gun body 302, thereby forms the perforating gun 300 (e.g., referring to FIG. 1). The one or more perforating guns may be coupled (e.g., threaded) together, and optionally, further coupled to a firing head (e.g., firing head 1006 of FIG. 10) and/or safety spacers (e.g., safety spacer 1002 of FIG. 10), to form the perforating tool assembly 102 of FIG. 1. The perforating tool assembly 102 is lowered on a conveyance 106 (e.g., referring to FIG. 1) to a desired depth within the wellbore 110, 214 and detonated to perforate the casing 112, 226 (e.g., referring to FIG. 1, 2).

As mentioned, the sacrificial fill material 702 occupies a substantial portion of the inner cavity 314 of the charge tube 304. Detonation creates expanding gases which pressurize the internal regions of the perforating gun. During detonation of the perforating tool assembly 102 (e.g., referring to FIG. 1), the sacrificial fill material 702 braces the internal surfaces of the charge tube 304 against impact and reducing the amount of hoop stress experienced by the perforating gun 300. Specifically, the sacrificial fill material 702 may be crushed, absorb shock, and/or undergo structure failure, i.e., deformation, thereby disallowing or reducing stress to reach the rest of the perforating gun. In addition, the sacrificial fill material 702 may partially absorb some of the explosive energy as well as transfer the energy to other regions of the gun and/or itself. The sacrificial fill material 702 may also serve to contain the hot, expanding gases of the detonation within the desired area, thereby ensuring detonation and subsequent hydraulic expansion, i.e., jetting, in the proper direction (e.g., firing direction 316 of FIG. 3). The sacrificial fill material 702 may also limit the propagation of fractures along the tubular bodies (e.g., charge tube 304, gun body 302, safety spacer(s), etc.) of the perforating tool assembly, thus reducing the risk of jamming of the tool in the wellbore 110, 214 (e.g., referring to FIG. 1) and thus ensuring that the perforating tool assembly is retrievable after detonation.

In one example, the energy absorbing function of the sacrificial fill material was observed when it had a specific strength ratio of 0.97 or less as compared to the specific strength of the gun carrier. In one or more examples, the sacrificial fill material may have a specific strength from about 0.001 megapascals per kilogram per cubic meter to about 0.07 megapascals per kilogram per cubic meter, or any ranges therebetween.

Figure 10:
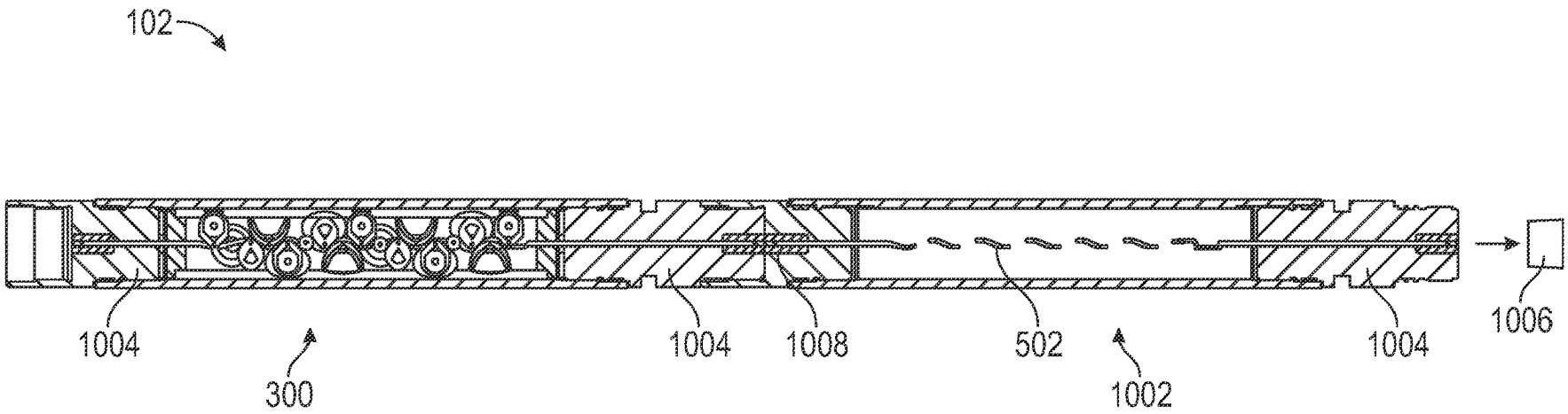
FIG. 10 is a cross-sectional view of a perforating tool assembly comprising a perforating gun and a safety spacer, in accordance with one or more examples of the present disclosure.

FIG. 10 illustrates a cross-sectional view of perforating tool assembly 102 comprising a perforating gun 300 and a safety spacer 1002, in accordance with one or more examples of the present disclosure. The safety spacer 1002 is shown as being disposed in the uphole direction of the perforating tool assembly relative to the perforating gun 300. As mentioned previously, one or more safety spacers 1002 may provide a separation distance between perforating guns 300 on a perforating tool assembly 102, or else a separation distance between the perforating tool assembly 102 and an uphole tool string, e.g., firing head 1006, or a combination thereof. In some examples, the one or more safety spacers 1002 may ensure a sufficient separation distance between the perforating tool assembly 102 and a rig floor, for example, a separation distance of at least 10' (3 meters). The one or more safety spacers 1002 may also be filled with the sacrificial fill material (e.g., sacrificial fill material 702 on FIG. 7). This may serve, in some examples, to mitigate propagation of fractures along the safety spacer following detonation. Also shown in this figure is the detonating cord 502 which may pass through the safety spacer 1002 to link the perforating gun 300 to the firing head 1006. The firing head 1006 may comprise, for example, any suitable initiator for initiating the detonation train, and which may be in electronic and/or wireless communication with an information handling system disposed at the surface. Bulkheads 1004, which may be threaded or threadless, may be used to secure the various tubulars of the perforating tool assembly 102 together. Each bulkhead 1004 may comprise a feedthrough 1008 to allow the detonating cord 502 and/or one or more signal transducers (e.g., wires) for conveying a detonating signal therethrough. In one or more examples, a bidirectional booster may be disposed within the feedthrough 1008 of each bulkhead 1004 to facilitate transmission of the detonation/firing signal from tubular to tubular.

Accordingly, the present disclosure may provide a perforating tool assembly having a reduced risk of failure. The methods, systems, and tools may include any of the various features disclosed herein, including one or more of the following statements.

Statement 1: A perforating gun comprising: a gun body; a charge tube disposed within the gun body; a plurality of charge cases disposed within the charge tube; and a sacrificial fill material disposed within at least a substantial portion of an inner cavity of the charge tube.

Statement 2: The perforating gun of statement 1, wherein the perforating gun further comprises a flexible sleeve disposed circumferentially about at least a portion of the charge tube.

Statement 3: The perforating gun of statement 2, wherein the flexible sleeve comprises a plastic film.

Statement 4: The perforating gun of statement 2, wherein the flexible sleeve comprises at least one material selected from the group consisting of: fabric, wrap, tape, tarp, paper, cloth, shrink wrap, sheet, wood, polymer, and any combinations thereof.

Statement 5: The perforating gun of any of statements 1-4, wherein the sacrificial fill material comprises foam.

Statement 6: The perforating gun of statement 5, wherein the foam comprises a compressible foam.

Statement 7: A method comprising: disposing one or more perforating guns in a wellbore, the one or more perforating guns comprising: a gun body; a charge tube disposed within the gun body; a plurality of charge cases disposed within the charge tube; and a sacrificial fill material disposed within at least a substantial portion of an inner cavity of the charge tube; detonating the perforating gun to create one or more perforations that extend from the wellbore into a subterranean formation penetrated by the wellbore, wherein the sacrificial fill material absorbs energy from the firing to reduce hoop stress on the gun body.

Statement 8: The method of statement 7, wherein the perforating gun further comprises a flexible sleeve disposed circumferentially about at least a portion of the charge tube.

Statement 9: The method of statement 8, wherein the flexible sleeve comprises a plastic film.

Statement 10: The method of statement 8, wherein the flexible sleeve comprises at least one material selected from the group consisting of: fabric, wrap, tape, tarp, paper, cloth, sheet, wood, polymer, plastic, and any combinations thereof.

Statement 11: The method of statement 8, wherein the flexible sleeve comprises an impact-resistant material.

Statement 12: The method of any of statements 7-11, wherein the sacrificial fill material comprises a foam.

Statement 13: The method of statement 12, wherein the foam comprises a compressible foam and/or a liquid-expanding foam.

Statement 14: The method of any of statements 7-13, wherein the sacrificial fill material comprises a liquid absorbent material.

Statement 15: The method of any of statements 7-14, wherein the sacrificial fill material comprises a settable material.

Statement 16: The method of any of statements 7-15, wherein the sacrificial fill material has a specific strength from 0.001 megapascals per kilogram per cubic meter and 0.07 megapascals per kilogram per cubic meter.

Statement 17: A method for assembling a perforating gun comprising: disposing a plurality of charge cases in a charge tube; disposing a flexible sleeve about an outer surface of the charge tube; filling at least a substantial portion of an inner cavity of the charge tube with a sacrificial fill material; and disposing the charge tube, the plurality of charge case, and the sacrificial fill material in a gun body.

Statement 18: The method of statement 17, further comprising fluidically coupling a source of the sacrificial fill material to the inner cavity of the charge tube.

Statement 19: The method of statements 17 or 18, further comprising spraying the sacrificial fill material within the inner cavity of the charge tube.

Statement 20: The method of any of statements 17-19, wherein the sacrificial fill material comprises a liquid hardening foam.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A perforating tool assembly comprising:

a perforating gun comprising:

a gun body;

a charge tube disposed within the gun body;

a flexible sleeve wrapped around the charge tube within the gun body;

a plurality of charge cases disposed within the charge tube;

a first region of inner cavity in between the plurality of charge cases;

a second region of inner cavity in between the gun body and the flexible sleeve;

a firing head;

a safety spacer in between the perforating gun and the firing head, wherein the safety spacer is disposed in an uphole direction of the perforating tool assembly relative to the perforating gun; and a sacrificial fill material disposed within the safety spacer and within a substantial portion of the first region and second region of inner cavity, wherein the sacrificial fill material was fluidically disposed into the inner cavity via a feedthrough.

2. The perforating gun of claim 1, wherein the flexible sleeve comprises a plastic film.

3. The perforating gun of claim 1, wherein the flexible sleeve comprises at least one material selected from the group consisting of: fabric, wrap, tape, tarp, paper, cloth, shrink wrap, sheet, wood, polymer, and any combinations thereof.

4. The perforating gun of claim 1, wherein the sacrificial fill material comprises a foam.

5. The perforating gun of claim 4, wherein the foam comprises a compressible foam.

6. A method comprising:

disposing a perforating tool string comprising:

one or more perforating guns in a wellbore, wherein at least one of the perforating guns comprises:

a gun body;

a charge tube disposed within the gun body;

a flexible sleeve wrapped around the charge tube within the gun body a plurality of charge cases disposed within the charge tube;

a first region of inner cavity in between the plurality of charge cases;

a second region of inner cavity in between the gun body and the flexible sleeve;

a firing head;

a safety spacer in between the perforating gun and the firing head, wherein the safety spacer is disposed in an uphole direction of the perforating tool string relative to the perforating gun, and a sacrificial fill material disposed within the safety spacer and within at least a substantial portion of the first region and second of inner cavity;

detonating the perforating gun to create one or more perforations that extend from the wellbore into a subterranean formation penetrated by the wellbore, wherein the sacrificial fill material absorbs energy from firing to reduce hoop stress on the gun body.

7. The method of claim 6, wherein the flexible sleeve is disposed circumferentially about the charge tube.

8. The method of claim 7, wherein the flexible sleeve comprises a plastic film.

9. The method of claim 7, wherein the flexible sleeve comprises at least one material selected from the group consisting of: fabric, wrap, tape, tarp, paper, cloth, sheet, wood, polymer, plastic, and any combinations thereof.

10. The method of claim 7, wherein the flexible sleeve comprises an impact-resistant material.

11. The method of claim 6, wherein the sacrificial fill material comprises a foam.

12. The method of claim 11, wherein the foam comprises a compressible foam and/or a liquid-expanding foam.

13. The method of claim 6, wherein the sacrificial fill material comprises a liquid absorbent material.

14. The method of claim 6, wherein the sacrificial fill material comprises a settable material.

15. The method of claim 6, wherein the sacrificial fill material has a specific strength from 0.001 megapascals per kilogram per cubic meter and 0.07 megapascals per kilogram per cubic meter.

* * * * *